United States Patent [19]

Synder

[11] 4,119,397

[45] * Oct. 10, 1978

[54] PRODUCT AND METHOD OF PRINTING CARPET-II

[75] Inventor: Robert W. Synder, Lancaster, Pa.

[73] Assignee: Armstrong Cork Company, Lancaster, Pa.

[ * ] Notice: The portion of the term of this patent subsequent to Jan. 18, 1994, has been disclaimed.

[21] Appl. No.: 757,877

[22] Filed: Jan. 10, 1977

[51] Int. Cl.[2] ..... D06P 7/00; D04H 18/00; D06P 5/00

[52] U.S. Cl. ..... 8/2.5 A; 8/1 XB; 8/17; 28/214; 428/95

[58] Field of Search ..... 8/2.5 R, 2.5 A, 1 XB

[56] References Cited

U.S. PATENT DOCUMENTS

| | | | |
|---|---|---|---|
| 3,782,896 | 1/1974 | Defago et al. | 8/2.5 R |
| 4,003,698 | 1/1977 | Snyder | 8/2.5 R |
| 4,013,407 | 3/1977 | Ray | 8/2.5 A |

*Primary Examiner*—Joseph L. Schofer
*Assistant Examiner*—Maria S. Tungol

[57] ABSTRACT

A pattern is placed on a carpet backing by the use of sublimable dyes. Carpet facing is tufted into the backing. Subsequent heating with vacuum action causes the sublimable dye to move from the carpet backing to the face yarn to provide the dyed pattern on the face yarn.

2 Claims, 2 Drawing Figures

PRODUCT AND METHOD OF PRINTING CARPET-II

CROSS-REFERENCE TO RELATED APPLICATION

The invention herein is an improvement over the invention set forth in Applicant's copending application, Ser. No. 612,907, now U.S. Pat. No. 4,003,698 filed Sept. 12, 1975, in the name of Robert W. Snyder and entitled "Product and Method of Printing Carpet".

BACKGROUND OF THE INVENTION

1. Field of the Invention

The invention is primarily directed to a technique for printing carpet, and more particularly, to a printing technique that uses sublimable dyes and uses the carpet backing as the transfer carrier for the sublimable dyes.

2. Description of the Prior Art

U.S. Pat. No. 3,782,896 discloses it is old to use transfer printing operations to print carpet designs.

Transfer printing through the use of sublimable dyes is an old art. Normally, the dye is carried on a transfer carrier or sheet, and the transfer carrier is placed up against the surface to be dyed. Through the use of heat and pressure, the sublimable dyes are converted to a vapor stage and transferred to the surface of a material adjacent the transfer carrier. The transfer carrier is then usually discarded. When one would attempt to transfer print heavy fabrics, such as carpet, then vacuum action would be required to attempt to secure some dye penetration into the fabric.

The inventive technique herein is the utilization of the transfer carrier as a portion of the finished product. Herein, specifically, the transfer carrier is used as the conventional backing for a carpet backing that has tufted thereinto the face carpet yarns which will be subsequently dyed by the sublimable dyes on the transfer carrier. The sublimable dyes are transferred through the face carpet yarns by the use of a vacuum operation.

SUMMARY OF THE INVENTION

A conventional carpet backing is provided with a pattern printed thereon through the use of inks containing sublimable dyes. After the inks have had an opportunity to dry, conventional yarn is tufted into the carpet backing to form the ultimate carpet product composed of a backing and tufted face yarn. Heat and vacuum are then used, and this causes the sublimable dyes to change to a vapor phase and be transferred from the carpet backing to the carpet face yarn. There then results a product which is composed of a carpet backing and face fiber yarns containing a decorative pattern thereon.

DESCRIPTION OF THE PREFERRED EMBODIMENT

The process herein is carried out by basically the following steps. A conventional carpet backing or scrim material, which preferably is porous in nature, is provided with a design printed thereon by a conventional Zimmer printer, utilizing inks containing sublimable dyes. Printing can be carried out by any commercially available printer, as long as it places the different inks in position in register. The printed carpet backing is then permitted to air dry. A conventional carpet yarn is tufted into the carpet backing by conventional tufting machinery. The pile or loops or face fiber yarns of the finished tufted yarn product will be preferably on the same side of the carpet backing as was the printed design containing sublimable dyes. The carpet backing with the tufted yarns is then subjected to heat and vacuum action whereby the pattern printed on the carpet backing is transferred from the carpet backing and fully developed throughout the height of the pile of the face yarns. There is then provided a carpet product which has a backing and yarn tufted into the face thereof with the yarn being dyed in a selected pattern.

Figure 1:
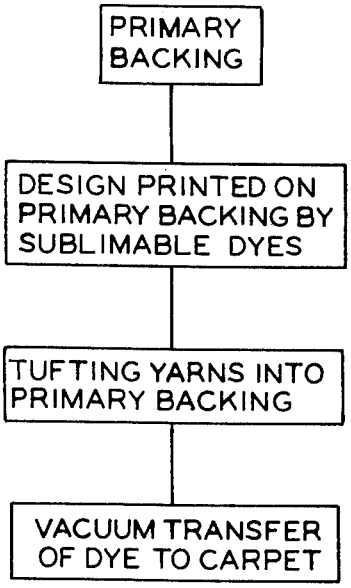
FIG. 1 is a schematic drawing of the process herein.
Figure 2:
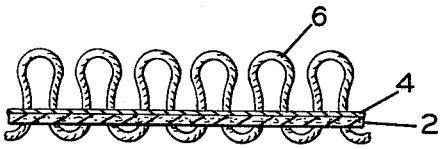
FIG. 2 is a cross-sectional view of the product of the invention herein.

In one specific example of the invention, conventional jute carpet backing with a 19 × 19 count is utilized. The 19 × 19 count is the number of yarns in the warp and woof direction. The aforesaid jute weighs approximately 6 ounces per square yard (203 grams per square meter). This material is run across a Zimmer printer and printed with conventional inks containing sublimable dyes. Specifically, the dyes being used are Latyl Cerise NSN, C.I. Disperse No. Red 60, C.I. Constitution No. 60756; Latyl Violet 2R, C.I. Disperse No. Violet 28, C.I. Constitution No. 61102; and Acetamine Yellow CG, C.I. Disperse No. Yellow 3, C.I. Constitution No. 11855. The design printed on the jute may be any type of aesthetic design, and after it is printed on the jute with the aforesaid sublimable dyes, it is permitted to dry. Nylon 66 yarn, Dupont Type 846, 1300 denier, bulk continuous filament is then tufted into the jute using a 5/64 gauge (0.2 cm), 12 tufts per inch to produce a ⅛ inch (0.3 cm) pile level loop carpet weighing 13 ounces per square yard (441 grams per square meter). This then yields a product similar to FIG. 2 wherein the carpet scrim 2 is provided with a design 4 and tufted yarn 6. The tufted yarns have their pile looped construction on the side of the carpet backing 2, which is the same side of the carpet backing 2 which has the printed design 4.

The product is then placed in a vacuum transfer device, such as that disclosed in British Pat. No. 1,363,145. Any type of apparatus may be utilized which will apply heat to the transfer sheet to vaporize the dye and then pull the dye by vacuum action from the transfer sheet through the carpet face fibers. The carpet would be positioned with the vacuum source on the face fiber side of the carpet so that the dye would be drawn from the back of the carpet through the face fiber yarns to the vacuum source.

The above-described product was placed in an apparatus similar to that of British Pat. No. 1,363,145 and was subjected to 205° C. dry heat for 3½ minutes at 28 inches mercury vacuum. During this time, the pattern 4 which was printed on the jute with sublimable dyes is transferred and fully developed throughout the height of the pile 6. The print is brightly colored with a soft, diffused appearance.

In addition to using jute as the backing material, the invention can be carried out with woven glass fibers or any other type of conventional carpet backing material which will be stable at approximately 200° C. to 220° C. In addition to using Nylon 66 as the carpet face yarn, the invention can be carried out using Nylon 6, acrylic and polyester fibers as the carpet face yarn. It has been found that in most cases, a 3 to 4 minute heating time is needed to sufficiently volatilize the dye to enable the vacuum action to pull the dye from the transfer sheet to the face fiber yarns of the carpet. It is equally clear that the invention can be carried out with other dyes, and depending upon the volatility rate of these dyes, different heating temperatures and transfer times may be needed. The essence of the invention herein is in the forming of the transfer sheet as part of the finished product and then the using of a vacuum as a means for drawing the volatilized dye from the transfer sheet to the carpet face yarns to appropriately dye the carpet face yarns.

The invention herein may be practiced using the dyes above described mixed together in different proportions or through the use of other dyes, as clearly set forth in Applicant's copending application Ser. No. 612,907. The inks are prepared in the manner set forth in application Ser. No. 612,907. The total disclosure of U.S. Application Ser. No. 612,907 as far as the usability of different dyes, backing materials and face fiber yarns is applicable to the invention herein. The invention herein is a modification of the structure of the aforesaid copending application by the same Applicant. Wherein, in this application, the transfer is carried out through the use of a vacuum means after heat has volatilized the dye, the aforesaid application either uses a positive air flow through the carpet to transfer the dye or simply permits convection of the dye.

What is claimed is:

1. A process for making decorative carpet through the use of sublimable dyes comprising the steps of:

(a) printing sublimable dyes on the carpet backing prior to the time the carpet face yarns are tufted into the carpet backing, (b) tufting the carpet face yarns into the carpet backing with the carpet face yarn pile being on the side of the carpet backing which contains the sublimable dyes, and then (c) transferring these sublimable dyes from the carpet backing to the carpet face yarn through the application of heat to the carpet to vaporize the dyes and the application of a vacuum to draw the dyes from the carpet backing to the carpet face yarns.

2. A process according to claim 1 wherein a vacuum source is disposed on the side of the carpet containing the carpet face yarns and draws the vaporized dyes from the carpet backing past the carpet face yarns towards the vacuum source.

* * * * *